US005592717A

United States Patent [19]

Longo

[11] Patent Number: 5,592,717

[45] Date of Patent: Jan. 14, 1997

[54] GATE HINGE

[76] Inventor: Pietro Longo, 6 Justin Ct., Saddle River, N.J. 07458

[21] Appl. No.: 346,872

[22] Filed: Nov. 30, 1994

[51] Int. Cl.[6] ..... E05D 13/10; E05D 7/06

[52] U.S. Cl. ..... 16/367; 16/239; 49/236; 49/240; 49/245

[58] Field of Search ..... 16/239, 240, 241, 16/242, 243, 244, 245, 365, 366, 367, 368; 49/236, 240, 241, 245

[56] References Cited

U.S. PATENT DOCUMENTS

| | | | |
|---|---|---|---|
| 138,081 | 4/1873 | Franklin | 16/239 |
| 247,094 | 9/1881 | Miller et al. . | |
| 265,890 | 10/1882 | Teeter . | |
| 348,381 | 8/1886 | Cole | 16/239 |
| 350,189 | 10/1886 | Denney . | |
| 514,375 | 2/1894 | Miller . | |
| 861,898 | 7/1907 | Reppert et al. | 49/241 |
| 897,296 | 9/1908 | Lester | 16/239 |
| 964,137 | 7/1910 | Williams | 16/239 |
| 1,123,913 | 1/1915 | Mueller | 16/239 |
| 1,214,623 | 2/1917 | Weber . | |
| 1,307,996 | 6/1919 | Beedle . | |
| 2,569,836 | 10/1951 | Tilbury . | |
| 3,264,786 | 8/1966 | Nettles . | |
| 4,611,433 | 9/1986 | Heizer, Jr. . | |

*Primary Examiner*—W. Donald Bray
*Attorney, Agent, or Firm*—Arthur Jacob

[57] ABSTRACT

A gate hinge hinges a gate to a vertical post at an installation site where the post projects vertically in an upward direction from a surface having a first surface portion extending laterally of the post in an inward direction normal to the upward direction of the post and a second surface portion inclined rearwardly of the post upwardly at an angle of inclination, the gate hinge including a hinge axis, mounting members mounting the gate hinge relative to the post with the hinge axis skewed relative to the direction of the post such that the hinge axis passes through a first location adjacent the upper end of the post and a second location vertically below the first location and placed rearwardly and outwardly, with respect to the post, relative to the first location, a bracket mounting the gate to the hinge for swinging movement about the hinge axis between a closed position and an open position, the bracket having bracket arms for locating the gate relative to the hinge axis such that the gate, when in the closed position, extends laterally inwardly, relative to the post, generally parallel to the first surface portion and vertically in a plane generally parallel to the post and, when in the open position, extends upwardly and rearwardly at essentially the angle of inclination of the second surface portion to extend generally parallel to the second surface portion, while located vertically in a plane generally parallel to the post.

10 Claims, 9 Drawing Sheets

GATE HINGE

The present invention relates generally to gate hinges and pertains, more specifically, to a gate hinge which enables compensation for the contour of the terrain at the site of the gate to assure that the gate follows the contour immediately adjacent the gate for appropriate fit and appearance during operation of the gate.

Gates have been in use since before recorded history for both functional and aesthetic purposes in providing selected access to a given path at a site along the path. A very large number of these gates are hinged to swing from a vertical post, between a closed position, in which access is precluded, and an open position, in which access is permitted. In installations where the gate is placed at a site along a path which, by virtue of the contour of the terrain at the site, rises immediately adjacent the gate, it becomes necessary to swing the gate in such a way as to clear the rising path as the gate is swung between a closed position and an open position. While gate hinges have been made available for attaining the clearance necessary for operation under the aforesaid circumstances, these known gate hinges do not enable the swinging gate to follow the contour of the path immediately adjacent the gate in a aesthetically pleasing orientation relative to the path and to the post upon which the gate is mounted.

Accordingly, the present invention provides a gate hinge which takes into account the sloping contour of the terrain in the vicinity of the gate and, as such, attains several objects and advantages, some of which are summarized as follows: Enables compensation for a sloping contour immediately adjacent the site of a gate to assure that the gate follows the sloping contour as the gate swings between a closed position and an open position, both for operational and aesthetic purposes; maintains a gate essentially parallel to the surface of the terrain at the site of the gate, at both the closed position and the open position of the gate, as the gate swings from a vertical post, in an aesthetically pleasing relationship with the post and with the surface of the terrain; provides a gate hinge having sufficient versatility and ease of adjustment for accommodating a wide variety of installations, thereby promoting widespread use; exhibits a relatively simple design for economical manufacture and ease of use; provides a relatively rugged construction for exemplary performance over an extended service life.

The above objects and advantages, as well as further objects and advantages, are attained by the present invention which may be described briefly as a gate hinge for hinging a gate to a post, the post having an upper end, an opposite lower end, a front face, a rear face opposite the front face, an outer side face and a laterally opposite inner side face, the post projecting in a vertically upward direction from a surface having a first surface portion extending laterally of the post in an inward direction normal to the post and a second surface portion inclined rearwardly of the post upwardly at an angle of inclination, the gate hinge comprising: a hinge having a hinge axis; mounting members for mounting the hinge relative to the post with the hinge axis skewed relative to the vertical direction such that the hinge axis passes through a first location adjacent the upper end of the post, and a second location vertically below the first location and placed rearwardly and outwardly, with respect to the post, relative to the first location; and a bracket for mounting the gate to the hinge for swinging movement about the hinge axis between a closed position and an open position; the bracket having bracket arms for locating the gate relative to the hinge axis such that the gate, when in the closed position, extends laterally inwardly, relative to the post, generally parallel to the first surface portion and vertically in a first plane extending laterally generally parallel to the post and, when in the open position, extends upwardly and rearwardly at essentially said angle of inclination to extend generally parallel to the second surface portion while located vertically in a second plane extending rearwardly generally parallel to the post.

The invention will be understood more fully, while still further objects and advantages will become apparent, in the following detailed description of a preferred embodiment of the invention illustrated in the accompanying drawing, in which.

Figure 1:
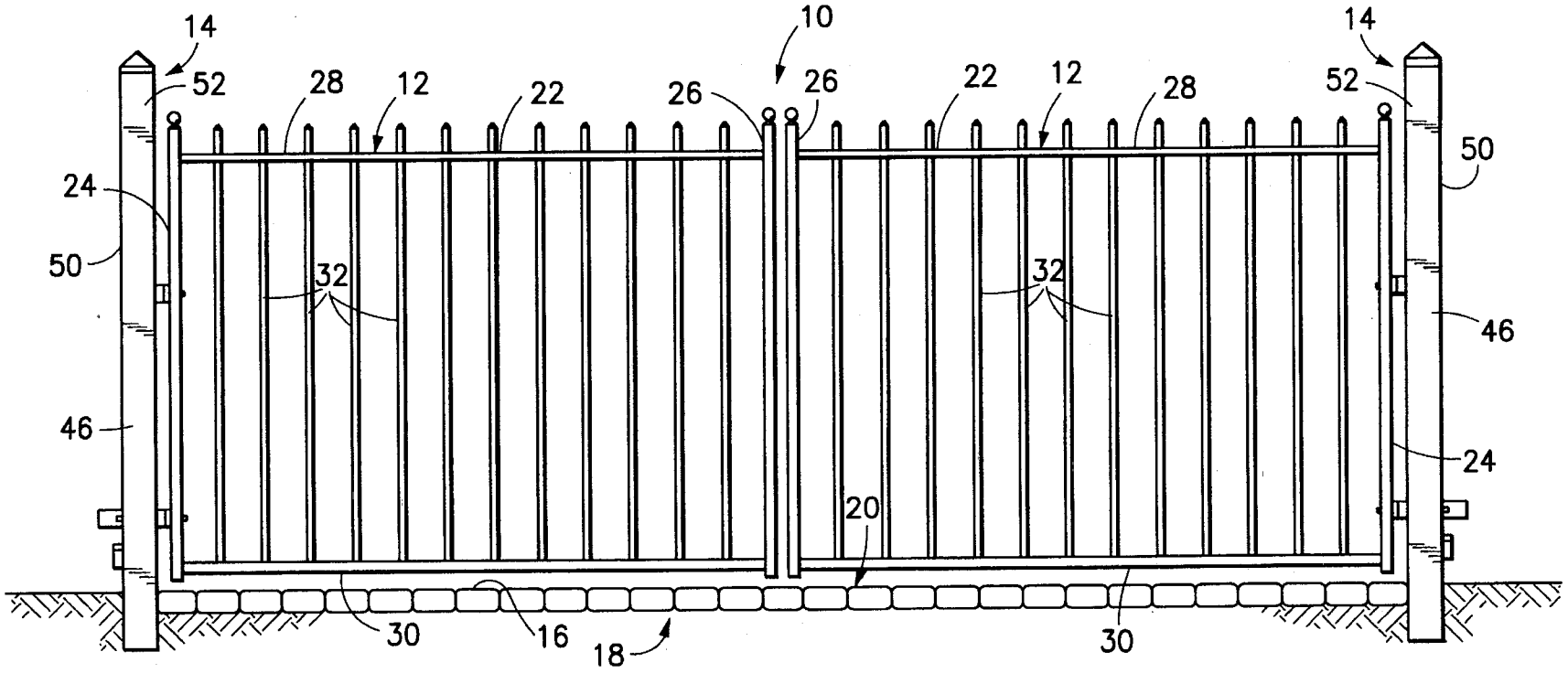
FIG. 1 is a front elevational view of a gate installation at a site utilizing gate hinges constructed in accordance with the present invention.

Referring now to the drawing, and especially to FIG. 1 thereof, a gate installation 10 is seen to include two gates 12, with each gate 12 hinged to a post 14 projecting in a vertically upward direction from a surface 16 at a site 18 along a path 20, across which path 20 the gate installation 10 places the gates 12 for swinging movement to provide selected access to the path 20 through the gate installation 10. In the position of the gates 12 illustrated in FIG. 1, the gates 12 are closed; that is, the gates 12 each extend laterally inwardly relative to each corresponding post 14 to be placed across the path 20 and close access to the path 20. Each gate 12 includes a frame 22 having an inner vertical member 24, an outer vertical member 26, interconnecting upper and lower horizontal members 28 and 30, respectively, and a plurality of vertical spindles 32 affixed to the frame 22 to complete the gate 12.

Figure 2:
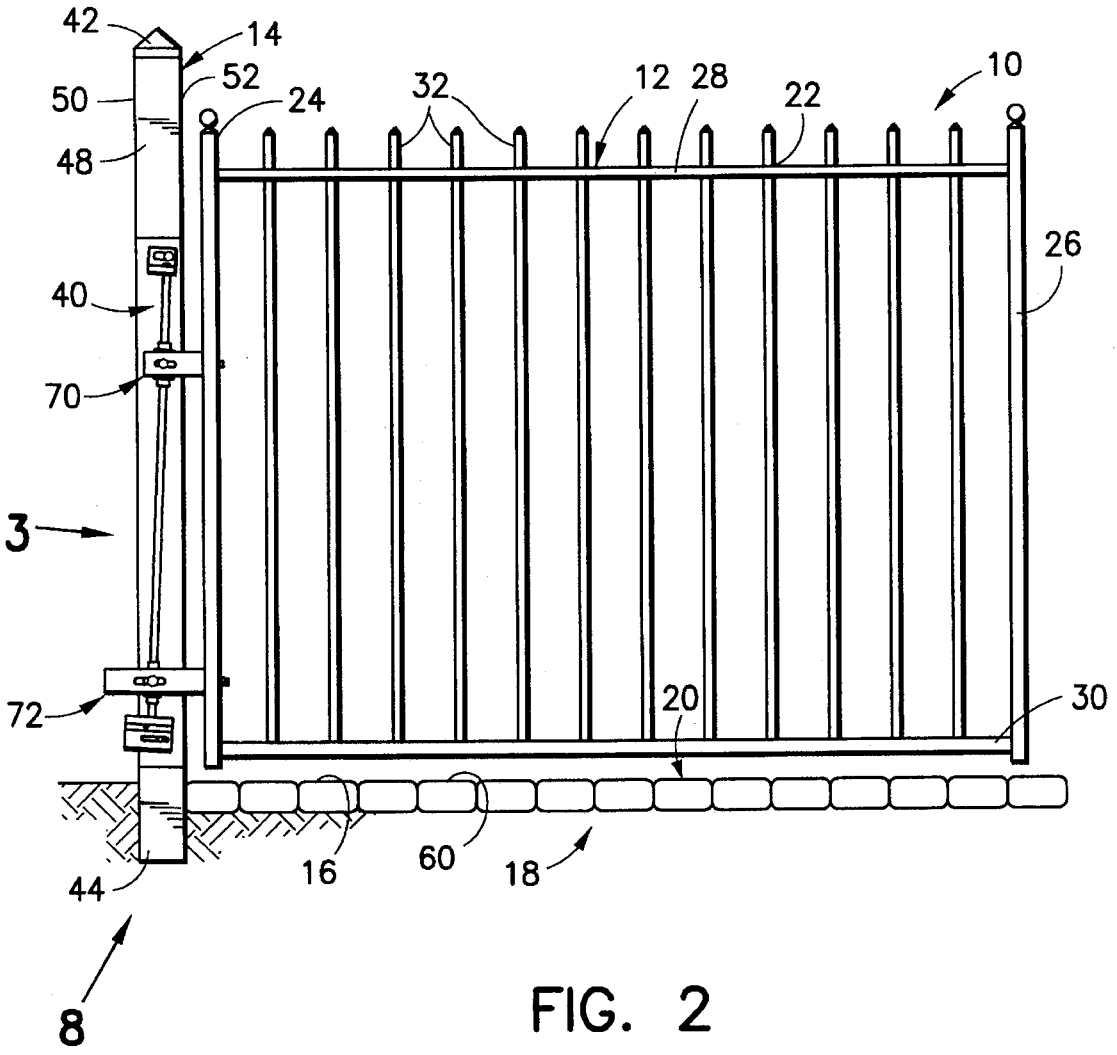
FIG. 2 is an enlarged rear elevational view of a gate at the site of FIG. 1.

As best seen in FIG. 2, each gate 12 is hinged to a corresponding post 14 by means of a gate hinge 40 constructed in accordance with the present invention. Post 14, which projects in a vertically upward direction from the surface 16, includes an upper end 42, an opposite lower end 44, a front face 46 (see FIG. 1), an opposite rear face 48, an outer side face 50 and an inner side face 52, and the gate hinge 40 couples the inner vertical member 24 of the gate 12 to the rear face 48 of the post 14 for swinging movement of the gate 12 relative to the post 14. In the closed position of gate 12 illustrated in FIG. 2, the gate 12 extends over a first surface portion 60 of the surface 16 at the site 18 to pass across the path 20, the first surface portion 60 spanning the distance between the posts 14 of the gate installation 10. The gate 12 extends laterally inwardly relative to post 14, in a direction essentially normal to the vertical direction of the post 14, and within a plane (the plane of the paper, in FIG. 2) extending laterally generally parallel to the post 14, thereby placing the gate 12 generally parallel to the first surface portion 60 of the surface 16; that is, the lower horizontal member 30 of the frame 22 of the gate 12 is oriented essentially parallel to the first surface portion 60, as shown.

Figure 3:
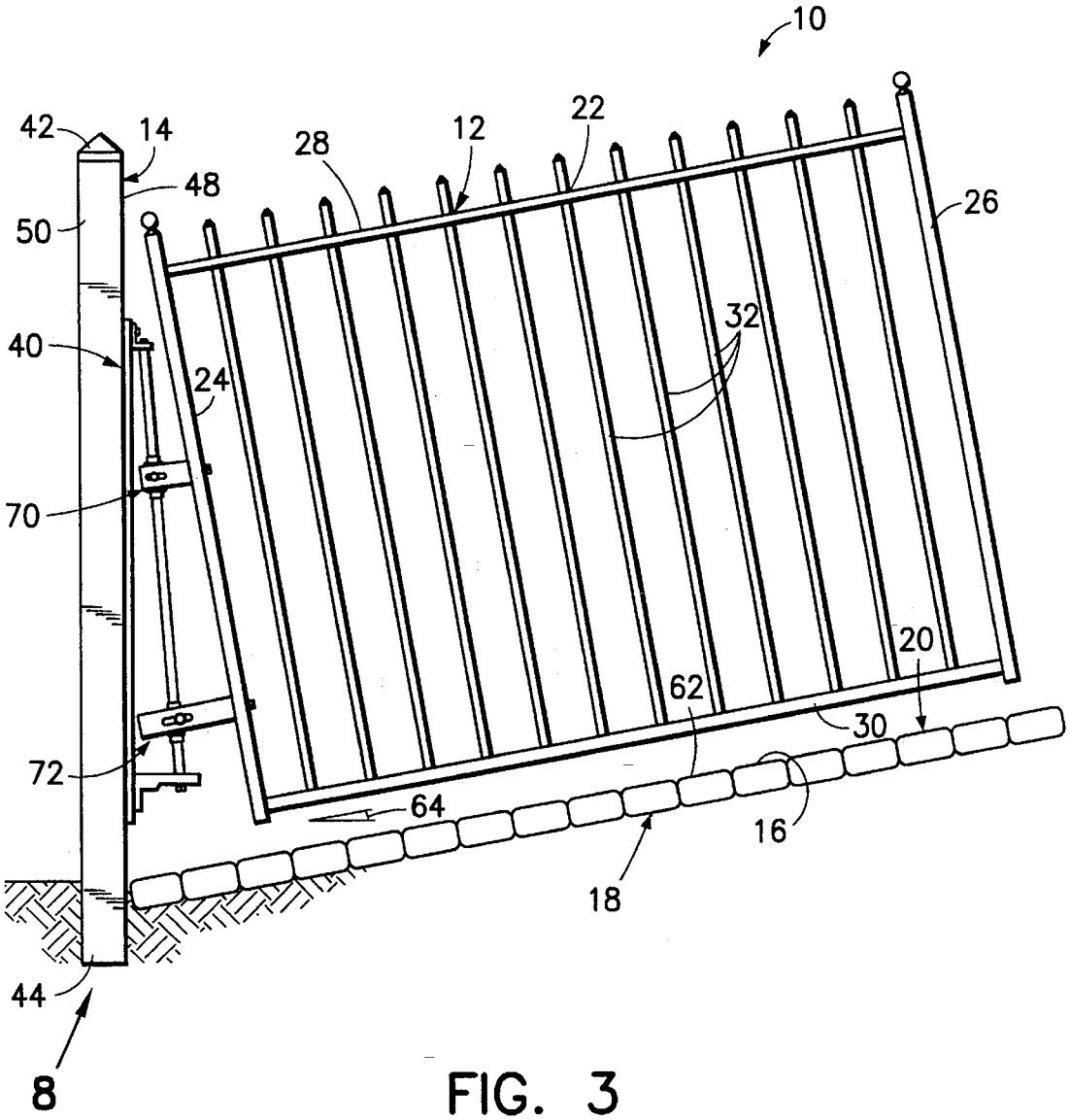
FIG. 3 is a side elevational view of the gate of FIG. 2, taken in the direction of the arrow in FIG. 2, but with the gate at another operating position.
Figure 4:
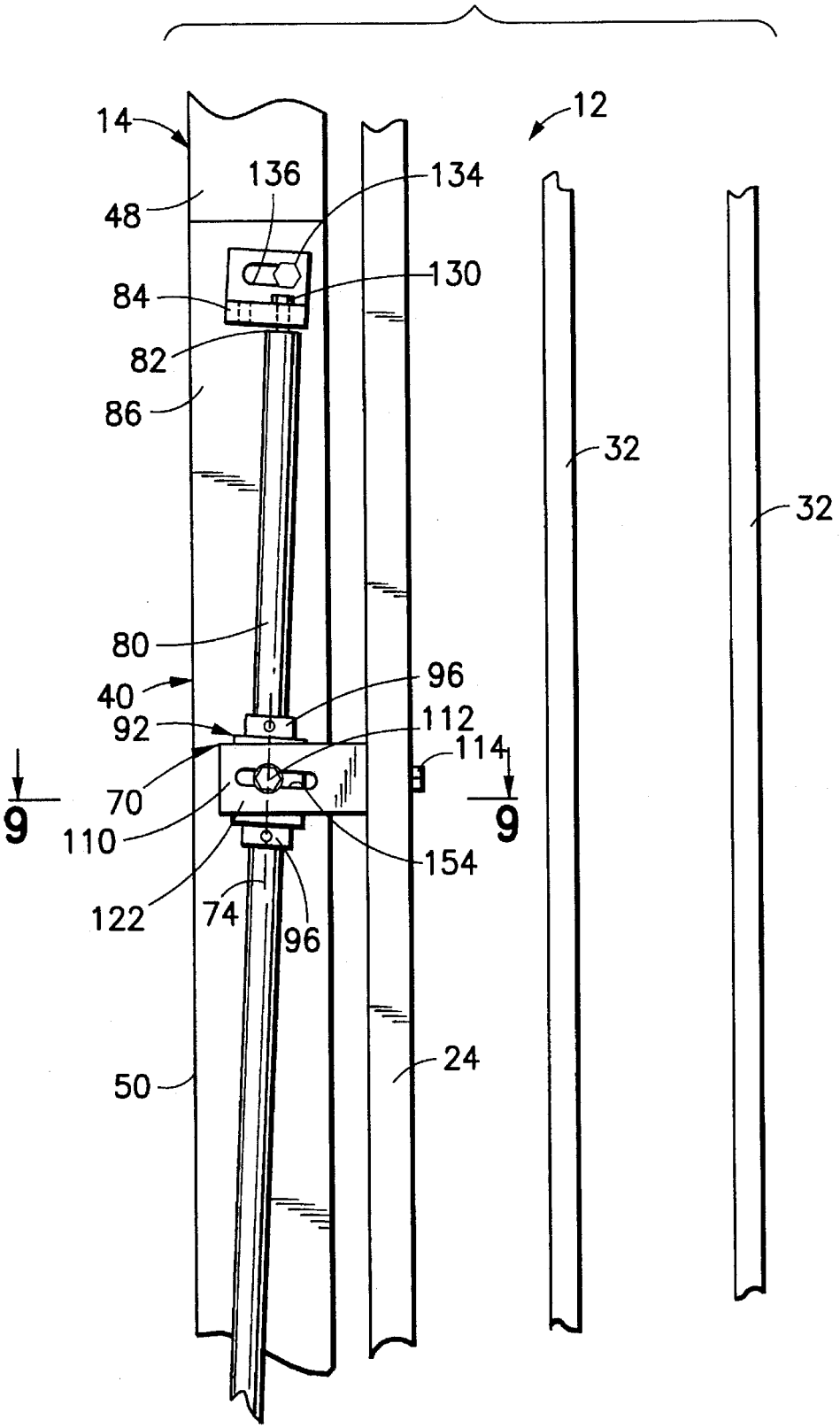
FIG. 4 is a further enlarged fragmentary view of a portion of the gate as shown in FIG. 2.
Figure 5:
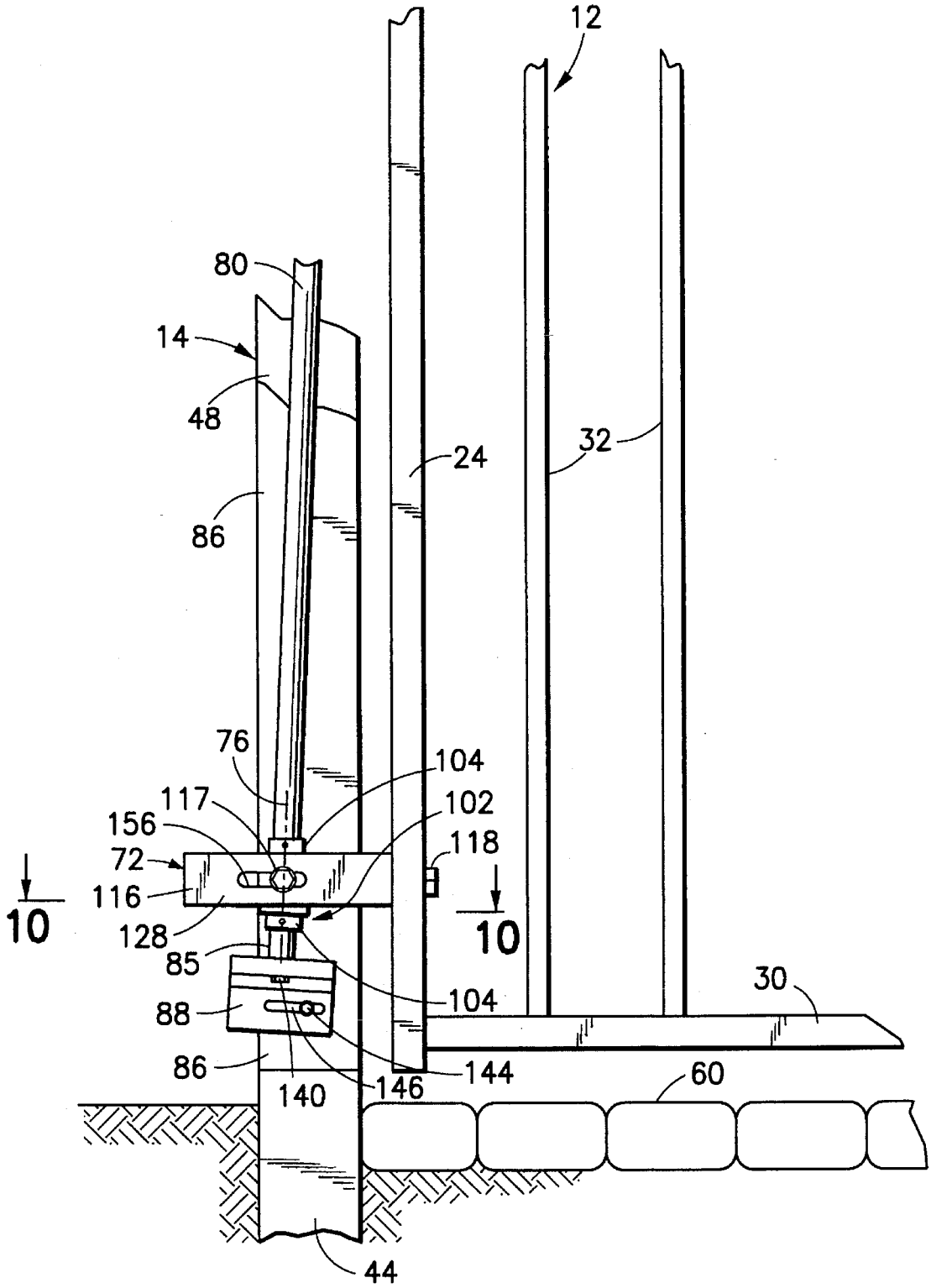
FIG. 5 is a further enlarged fragmentary view of another portion of the gate as shown in FIG. 2.
Figure 6:
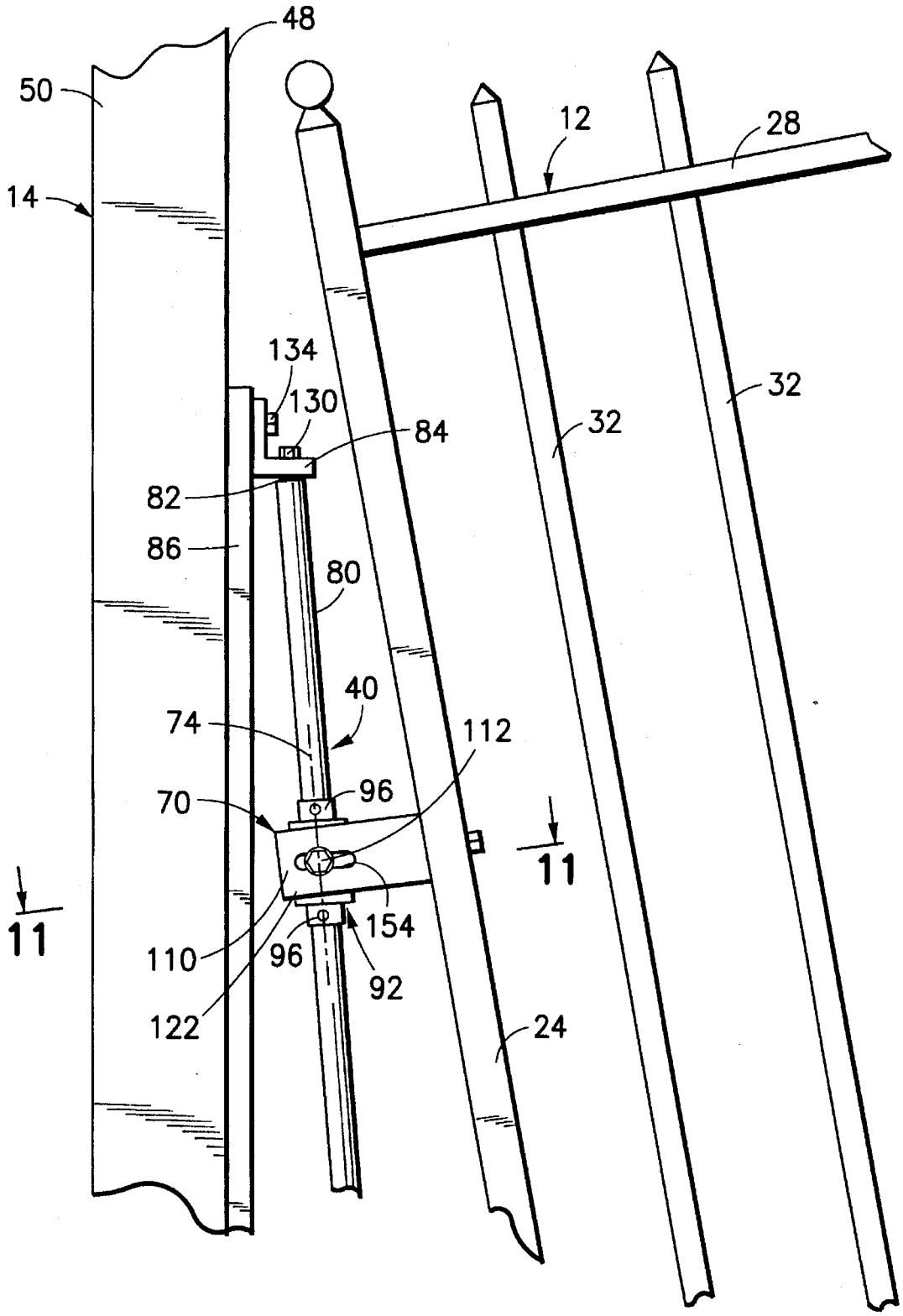
FIG. 6 is a further enlarged fragmentary view of a portion of the gate as shown in FIG. 3.
Figure 7:
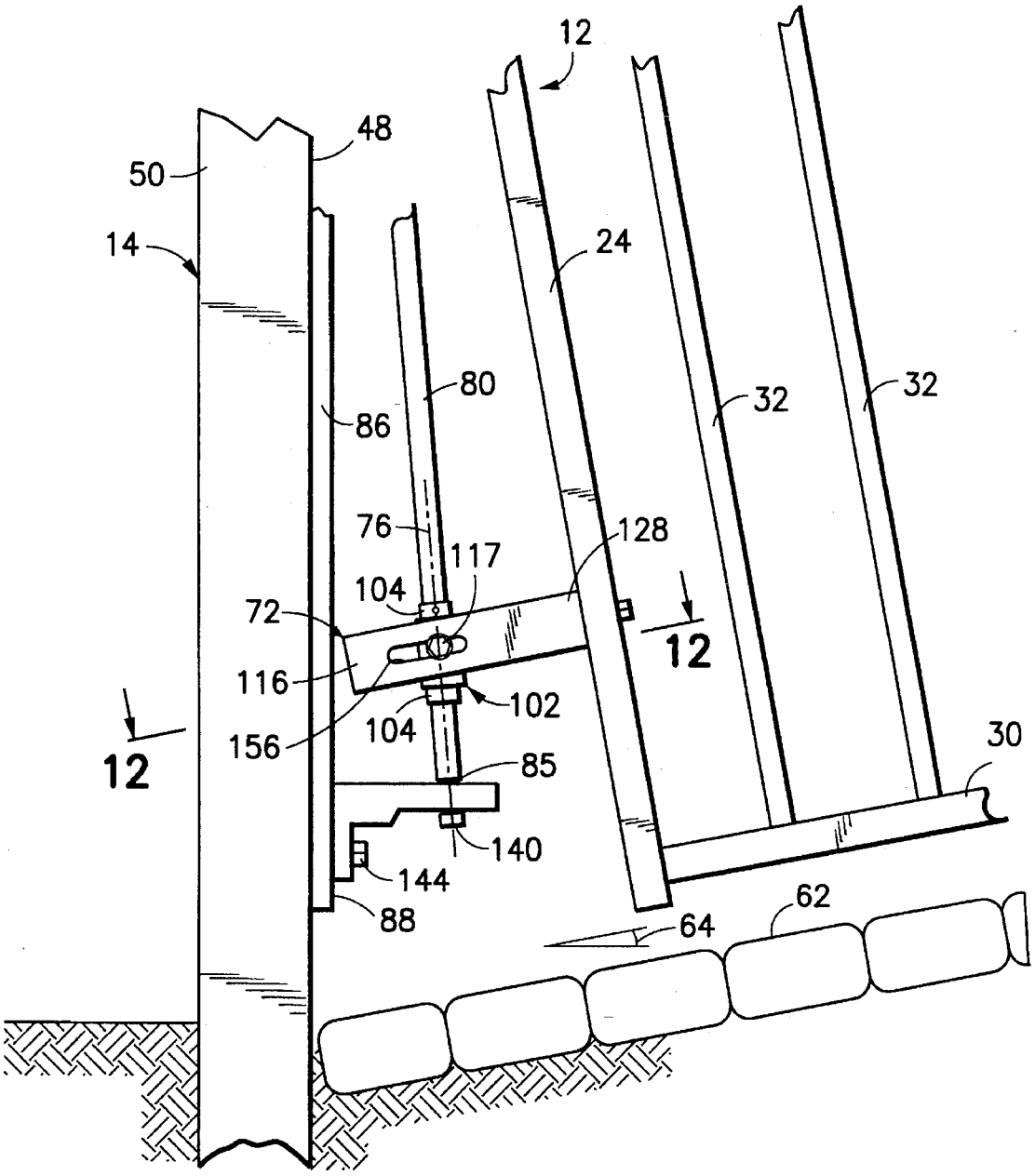
FIG. 7 is a further enlarged fragmentary view of another portion of the gate as shown in FIG. 3.

The contour of the terrain at the site 18 is such that the path 20 rises immediately behind the gate installation 10, as illustrated in FIG. 3 by a second surface portion 62 of the surface 16, which second surface portion 62 rises at an angle of inclination 64 behind the position of gate 12 when closed. Gate hinge 40 is constructed so as to assure that as the gate 12 is swung to the open position shown in FIG. 3, the gate 12 clears the rising second surface portion 62 of the surface 16 and, upon placement of the gate 12 at the open position, the gate 12 is parallel to the rising second surface portion 62; that is, the lower horizontal member 30 of the frame 22 of the gate 12 is oriented essentially parallel to the second surface portion 62, as shown. Thus, in the open position, gate 12 extends upwardly and rearwardly at essentially the angle of inclination 64 to extend generally parallel to the second surface portion 62 while located vertically in a plane (the plane of the paper, in FIG. 3) extending rearwardly generally parallel to the post 14. In this manner, the gate 12 not only functions properly to enable unencumbered swinging movement between the closed position and the open position, despite the rising slope of the path 20 behind the position of gate 12 when closed, but provides an aesthetically pleasing orientation of the gate 12 relative to the surface 16, as well as relative to the post 14, in both the closed position and the open position of the gate 12.

Figure 8:
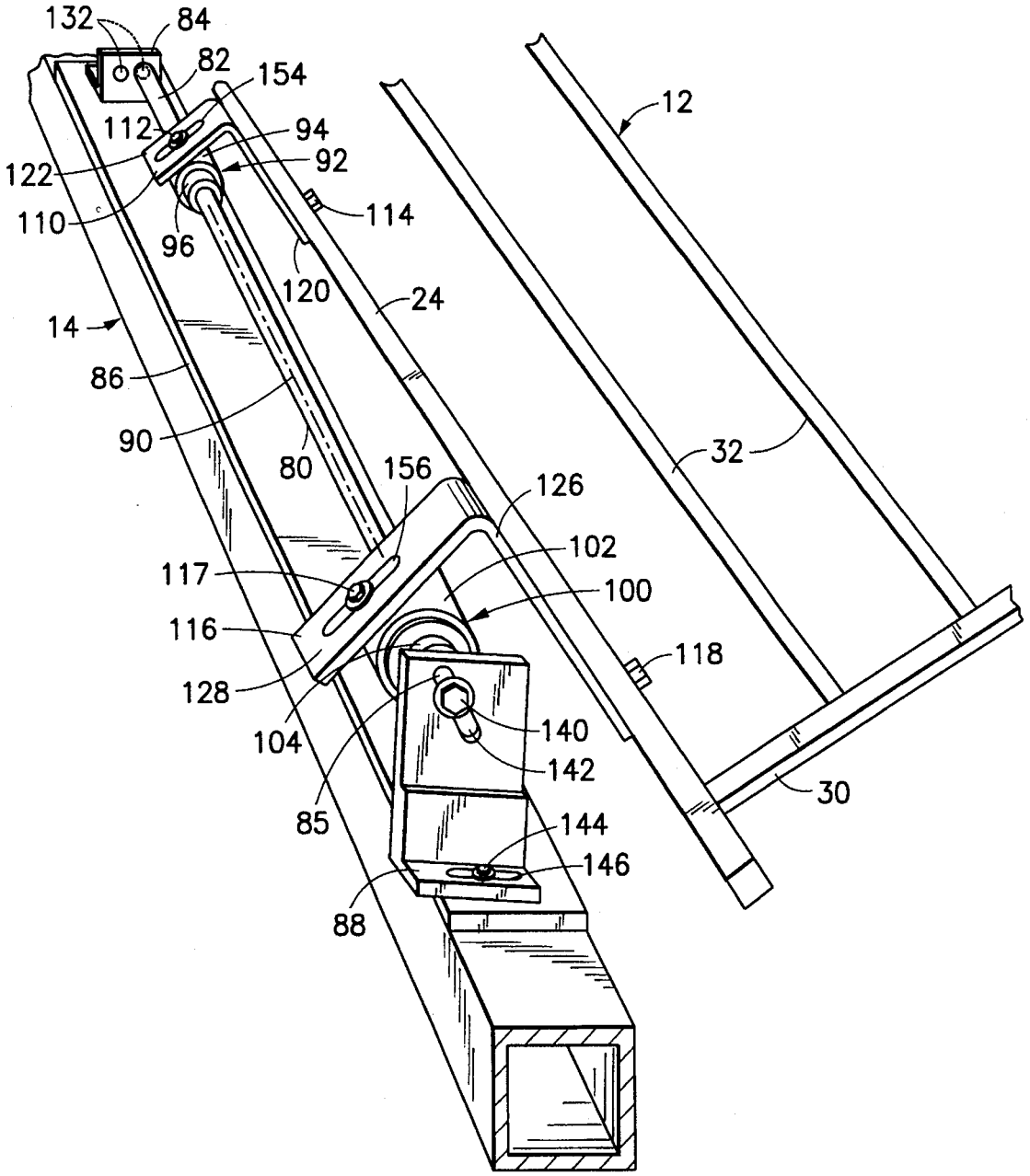
FIG. 8 is an enlarged fragmentary perspective view taken in the direction of the arrow in FIGS. 2 and 3, but with the gate in an intermediate position between the positions illustrated in FIGS. 2 and 3.

In order to accomplish the desired orientation of gate 12 in both the closed position, as illustrated in FIG. 2, and the open position, as shown in FIG. 3, gate hinge 40 includes an upper hinge 70 located adjacent the upper end 42 of the post 14 and a lower hinge 72 located adjacent the lower end 44 of the post 14. As best seen in FIGS. 4 through 7, as well as in FIGS. 2 and 3, the upper hinge 70 establishes a hinge axis 74 adjacent the upper end 42 of the post 14, while the lower hinge 72 establishes a hinge axis 76 adjacent the lower end 44 of the post 14, with the lower hinge axis 76 being located rearwardly and outwardly of the upper hinge axis 74, relative to post 14. In the illustrated preferred embodiment, gate hinge 40 includes a rod 80 affixed at the upper end 82 thereof to a backing member 86 which, in turn, is secured to the rear face 48 of the post 14, adjacent the upper end 42 of the post 14, by an upper mounting member 84. Rod 80 is affixed at the lower end 85 thereof to the post 14, adjacent the lower end 44 of the post 14, by a lower mounting member 88 secured to the backing member 86. As best seen in FIG. 8, the mounting members 84 and 88 secure the rod 80 in a skewed orientation relative to the post 14, such that the central axis 90 of rod 80 is skewed, with the lower end 85 of the rod 80 located rearwardly and outwardly of the upper end 82 of the rod 80, relative to the post 14.

An upper bearing 92 includes a sleeve 94 journaled for rotation about the rod 80 at an upper location adjacent the upper end 42 of the post 14. Upper bearing 92 is retained at the upper location by a collars 96 secured to the rod 80 at either end of the upper bearing 92. Likewise, a lower bearing 100 includes a sleeve 102 journaled for rotation about the rod 80 at a lower location adjacent the lower end 44 of the post 14, lower bearing 100 being retained at the lower location by collars 104 secured to the rod 80 at either end of the lower bearing 100.

An upper bracket 110 is affixed to the sleeve 94 of the upper bearing 92, as by a threaded fastener 112, and is affixed to the inner vertical member 24 of gate 12, as by a threaded fastener 114, while a lower bracket 116 is affixed to the sleeve 102 of the lower bearing 100 and to the inner vertical member 24, as by threaded fasteners 117 and 118, to couple the gate 12 with the bearings 92 and 100. The gate 12 thus swings about the central axis 90 of the rod 80, which central axis 90 is common with the hinge axes 74 and 76 by virtue of the placement of the upper and lower bearings 92 and 100 on the rod 80. The skewed arrangement of the rod 80, and the central axis 90 of the rod 80, enable the gate 12 to swing between the closed position, wherein the gate 12 is essentially horizontal and generally parallel with the first surface portion 60, and the open position, wherein gate 12 is inclined upwardly at essentially the angle of inclination 64 so as to be generally parallel with the second surface portion 62, as will be explained further below.

Figure 9:
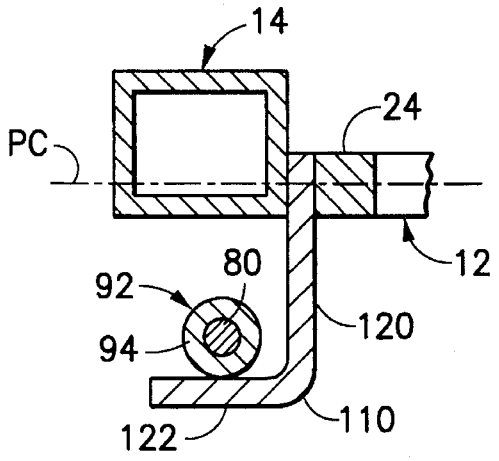
FIG. 9 is a diagrammatic cross-sectional view taken along the line 9—9 of FIG. 4.
Figure 11:
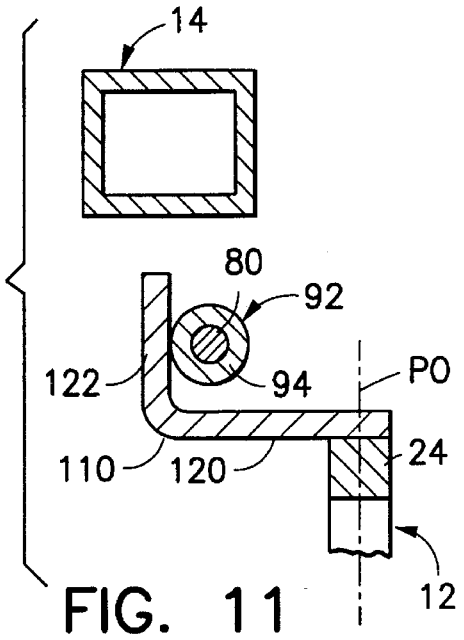
FIG. 11 is a diagrammatic cross-sectional view taken along the line 11—11 of FIG. 6.
Figure 10:
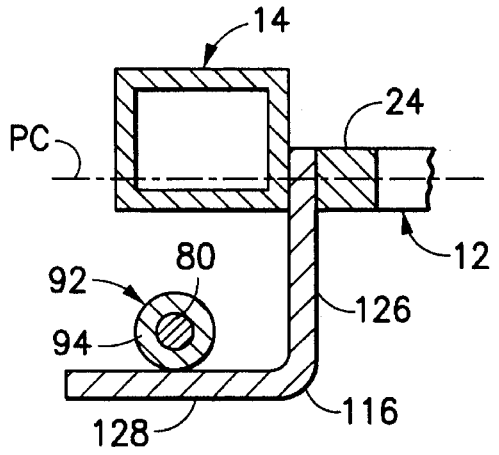
FIG. 10 is a diagrammatic cross-sectional view taken along the line 10—10 of FIG. 5.
Figure 12:
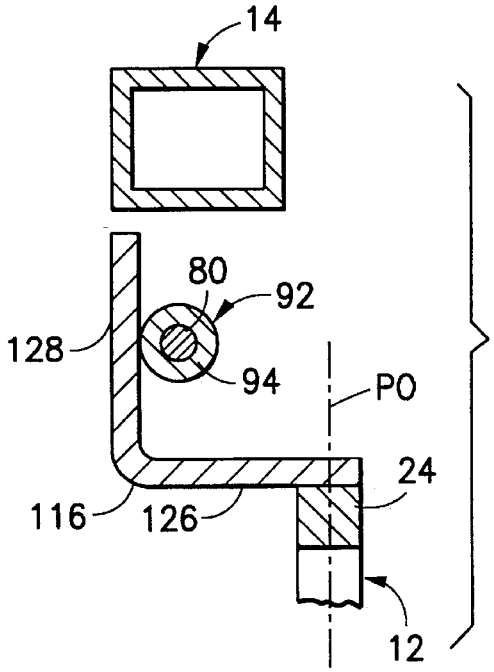
FIG. 12 is a diagrammatic cross-sectional view taken along the line 12—12 of FIG. 7.

Turning now to FIGS. 9 through 12, as well as to FIGS. 2 through 8, each upper bracket 110 includes a first bracket arm 120 secured to the inner vertical member 24 of the gate 12, and a second bracket arm 122 secured to the sleeve 94 of the upper bearing 92. Similarly, each lower bracket 116 includes a first bracket arm 126 secured to the inner vertical member 24 of the gate 12, and a second bracket arm 128 secured to the sleeve 102 of the lower bearing 100. In the closed position of gate 12, the desired orientation of the gate 12, projecting from the post 14 in a laterally inward direction normal to the direction of the post 14 and extending essentially parallel to the first surface portion 60 and vertically in a first plane PC (the plane of the paper in FIG. 2) extending laterally generally parallel to the post 14, is accomplished by the location of the hinge axes 74 and 76 relative to the post 14 and the relative lengths of the bracket arms 120, 122 and 126, 128 of the respective brackets 110 and 116, which place the gate 12 in the desired orientation while coupling the gate 12 to the hinges 70 and 72, as depicted in FIGS. 9 and 10. When the gate 12 is swung to the open position, the desired orientation of the gate 12, projecting from the post 14 upwardly and rearwardly at essentially the angle of inclination 64 to extend generally parallel to the second surface portion 62 while located in a second plane PO (the plane of the paper in FIG. 3) extending rearwardly generally parallel to the post 14, again is accomplished by the location of the hinge axes 74 and 76 relative to the post 14 and the relative lengths of the bracket arms 120, 122 and 126, 128 of the respective brackets 110 and 116, which place the gate 12 in the desired orientation while coupling the gate 12 to the hinges 70 and 72, as depicted in FIGS. 11 and 12.

In order to accommodate various slopes in the surface contours encountered in the terrain at different sites, while still attaining the desired orientation of the gate 12 at the closed position and at the open position, adjustments are made available for affixing the gate 12 to the post 14 at a selected location of gate 12 relative to the post 14. Referring now to FIGS. 2 through 8, the upper end 82 of rod 80 is affixed to upper mounting member 84 by a bolt 130 which passes through a selected one of two apertures 132 in the upper mounting member 84 and is threaded into the upper end 82 of the rod 80. In addition, upper mounting member 84 is secured to backing member 86 by a bolt 134 which passes through a slot 136 in the upper mounting member 84. The lower end 85 of rod 80 is affixed to lower mounting member 88 by a bolt 140 threaded into the lower end 85 of the rod 80 and extending through a slot 142 in the lower mounting member 88, and lower mounting member 88 is secured to backing member 86 by a further bolt 144 passing through a slot 146 in the lower mounting member 88. Backing member 86 is secured to the rear face 48 of the post 14. Additionally, the brackets 110 and 116 are secured to corresponding bearings 92 and 100 by the threaded fasteners 112 and 117 which pass through corresponding slots 154 and 156 in the bracket arms 122 and 128 of respective brackets 110 and 116. The manipulation of the relative positions of the upper end 82 and the lower end 85 of the rod 80 permitted by the selected positions available as a result of the bolted connections between the rod 80 and the upper mounting member 84 and the lower mounting member 88, and between the brackets 110 and 116 and the respective bearings 92 and 100, as well as the selected location of the bearings 92 and 100 along the rod 80, as permitted by the collars 96 and 104, enables adjustments to accommodate the characteristics of the site 18 of the gate installation 10.

Thus, in a typical installation, the gate posts 14 are installed so as to extend vertically, placed plumb in all directions, as illustrated, and each gate hinge 40 is attached to a gate post 14 by securing the corresponding backing member 86 to the gate post 14. Rod 80 is affixed to backing member 86 by means of upper and lower mounting members 84 and 88, as set forth above. The angle of inclination 64 of the second surface portion 62 of the surface 16 is measured, and the lower end 85 of the rod 80 then is moved along slot 142 in the lower mounting member 88 in proportion to the measured angle of inclination 64, thereby skewing the central axis 90 of the rod 80, relative to the gate post 14, with the lower end 85 of the rod 80 located further rearwardly and outwardly of the upper end 82 of the rod 80 for greater angles of inclination 64, until the skew of the central axis 90 accommodates the angle of inclination 64 so as to maintain the gate 12 generally parallel with the second surface portion 62, when the gate 12 is in the open position.

The rod 80 then is secured in place, with the lower end 85 of rod 80 locked in place by means of the bolt 140, and the gate 12 is mounted upon the upper and lower hinges 70 and 72 by means of the threaded fasteners 112 and 117, as described above. Before tightening the threaded fasteners 112 and 117, the gate 12, in the closed position thereof, is placed generally parallel to the first surface portion 60, with adjustment of the position of gate 12 relative to the hinges 70 and 72 enabled by the slots 154 and 156 to assure the desired generally parallel orientation, prior to tightening of the threaded fasteners 112 and 117. Once the threaded fasteners 112 and 117 are tightened to secure the gate 12 in place upon the hinges 70 and 72, the gate 12 may be swung between the closed position and the open position. The height of either gate 12 may be adjusted in order to place both gates 12 at the same height merely by adjusting the location of the hinges 70 and 72 along the rod 80, as described above. Where conditions at the site 18 require adjustments which lie beyond the range of adjustments provided by the slots 142, 154 and 156, the further slots 136 and 146 and the alternate aperture 132 may be employed to extend the range of adjustments.

It will be seen that the gate hinge 40 of the present invention attains the several objects and advantages summarized above, namely: Enables compensation for a sloping contour immediately adjacent the site of a gate to assure that the gate follows the sloping contour as the gate swings between a closed position and an open position, both for operational and aesthetic purposes; maintains a gate essentially parallel to the surface of the terrain at the site of the gate, at both the closed position and the open position of the gate, as the gate swings from a vertical post, in an aesthetically pleasing relationship with the post and with the surface of the terrain; provides a gate hinge having sufficient versatility and ease of adjustment for accommodating a wide variety of installations, thereby promoting widespread use; exhibits a relatively simple design for economical manufacture and ease of use; provides a relatively rugged construction for exemplary performance over an extended service life.

It is to be understood that the above detailed description of a preferred embodiment of the invention is provided by way of example only. Various details of design and construction may be modified without departing from the true spirit and scope of the invention, as set forth in the appended claims.

The embodiments of the invention in which an exclusive property or privilege is claimed are defined as follows:

1. A gate hinge for hinging a gate to a post, the post having an upper end, an opposite lower end, a front face, a rear face opposite the front face, an outer side face and a laterally opposite inner side face, the post projecting in a vertically upward direction from a surface having a first surface portion extending laterally of the post in an inward direction normal to the direction of the post and a second surface portion inclined rearwardly of the post upwardly at an angle of inclination, the gate hinge comprising:

a first hinge providing a first hinge axis at a first location for placement adjacent the upper end of the post;

a second hinge providing a second hinge axis at a second location vertically below the first location for placement adjacent the lower end of the post, with the second location placed rearwardly and outwardly relative to the first location;

a first bracket for mounting the gate to the first hinge for swinging movement about the first hinge axis; and a second bracket for mounting the gate to the second hinge for swinging movement about the second hinge axis;

the first and second brackets mounting the gate for swinging movement about the first and second hinge axes between a closed position and an open position, the first and second brackets having bracket arms for locating the gate relative to the respective first and second hinge axes such that the gate, when in the closed position, extends laterally inwardly, relative to the post, generally parallel to the first surface portion and vertically in a first plane extending laterally generally parallel to the post and, when in the open position, extends upwardly and rearwardly at essentially said angle of inclination to extend generally parallel to the second surface portion while located vertically in a second plane extending rearwardly generally parallel to the post.

2. The invention of claim 1 wherein the gate hinge includes a rod having an upper end and a lower end, the rod extending between the first hinge and the second hinge and being inclined outwardly and rearwardly, relative to the direction of the post, from the first hinge toward the second hinge, the first hinge and the second hinge being mounted on the rod.

3. The invention of claim 2 including a first mount adjacent the upper end of the rod for mounting the upper end of the rod to the post, and a second mount adjacent the lower end of the rod for mounting the lower end of the rod to the post, the first and second mounts including selectively adjustable mounting members for selectively adjusting the location of each of the upper end and the lower end of the rod relative to the post so as to enable selective adjustment of the inclination and location of the rod relative to the post.

4. The invention of claim 3 including selectively adjustable securing members for selectively adjusting the location of each of the first and second brackets relative to the respective first and second hinges so as to enable selective adjustment of the location of the gate relative to the post.

5. A gate hinge for hinging a gate to a post, the post having an upper end, an opposite lower end, a front face, a rear face opposite the front face, an outer side face and a laterally opposite inner side face, the post projecting in a vertically upward direction from a surface having a first surface portion extending laterally of the post in an inward direction normal to the post and a second surface portion inclined rearwardly of the post upwardly at an angle of inclination, the gate hinge comprising:

a hinge having a hinge axis;

mounting members for mounting the hinge relative to the post with the hinge axis skewed relative to the vertical direction such that the hinge axis passes through a first location adjacent the upper end of the post, and a second location vertically below the first location and placed rearwardly and outwardly, with respect to the post, relative to the first location; and a bracket for mounting the gate to the hinge for swinging movement about the hinge axis between a closed position and an open position;

the bracket having bracket arms for locating the gate relative to the hinge axis such that the gate, when in the closed position, extends laterally inwardly, relative to the post, generally parallel to the first surface portion and vertically in a first plane extending laterally generally parallel to the post and, when in the open position, extends upwardly and rearwardly at essentially said angle of inclination to extend generally parallel to the second surface portion while located vertically in a second plane extending rearwardly generally parallel to the post.

6. The invention of claim 5 wherein the hinge includes an upper end and a lower end, and the mounting members include selectively adjustable mounts for selectively adjusting the location of each of the upper end and the lower end of the hinge relative to the post so as to enable selective adjustment of the inclination and location of the hinge axis relative to the post.

7. The invention of claim 6 including selectively adjustable securing members for selectively adjusting the location of the bracket relative to the hinge so as to enable selective adjustment of the location of the gate relative to the post.

8. The invention of claim 5 wherein the gate hinge includes a rod having an upper end and a lower end, and an upper bearing and a lower bearing, the rod extending between the upper bearing and the lower bearing and being inclined outwardly and rearwardly, relative to the direction of the post, from the upper bearing toward the lower bearing, the upper bearing and the lower bearing being mounted on the rod.

9. The invention of claim 8 wherein the mounting members include a first mount adjacent the upper end of the rod for mounting the upper end of the rod to the post, and a second mount adjacent the lower end of the rod for mounting the lower end of the rod to the post, the first and second mounts including selectively adjustable mounts for selectively adjusting the location of each of the upper end and the lower end of the rod relative to the post so as to enable selective adjustment of the inclination and location of the rod relative to the post.

10. The invention of claim 9 including securing means for securing the bracket arms to the upper and lower bearings, the securing means including selectively adjustable securing members for selectively adjusting the location of at least one of the bracket arms relative to the corresponding bearing so as to enable selective adjustment of the location of the gate relative to the post.

* * * * *